United States Patent [19]

Stoner

[11] Patent Number: 4,942,802

[45] Date of Patent: Jul. 24, 1990

[54] CONVERTIBLE, BELT/CLIP-FED AUTOMATIC GUN WITH POSITIVE SHELL CASING EJECTION

[75] Inventor: Eugene M. Stoner, Palm City, Fla.

[73] Assignee: ARES, Inc., Port Clinton, Ohio

[21] Appl. No.: 100,388

[22] Filed: Sep. 24, 1987

[51] Int. Cl.[5] ..... F41D 10/14

[52] U.S. Cl. ..... 89/191.01; 89/33.14; 42/25

[58] Field of Search ..... 89/191.01, 33.14, 33.2, 89/185, 33.1; 42/25, 50

[56] References Cited

U.S. PATENT DOCUMENTS

| | | | |
|---|---|---|---|
| 709,882 | 9/1902 | DeKnight | 89/33.14 |
| 1,290,850 | 1/1919 | Sturgeon | 89/33.1 |
| 1,343,444 | 6/1920 | Formby | 42/50 |
| 1,696,537 | 12/1928 | Kewish | 89/185 |
| 1,803,349 | 5/1931 | Pfeiffer | 89/33.2 |
| 2,466,564 | 4/1949 | Stephenson | 89/33.2 |
| 3,198,076 | 8/1965 | Stoner | 89/33.1 |
| 3,386,336 | 6/1968 | Roy | 89/33.2 |
| 3,455,204 | 7/1969 | Stoner | 89/33.2 |
| 3,680,432 | 8/1972 | Rocha | 89/33.2 |
| 3,960,053 | 6/1976 | Conley | 89/185 |
| 4,112,817 | 9/1978 | Bourlet | 89/33.1 |

FOREIGN PATENT DOCUMENTS

| | | | |
|---|---|---|---|
| 504332 | 4/1920 | France | 89/33.2 |

*Primary Examiner*—Deborah L. Kyle
*Assistant Examiner*—Stephen Johnson
*Attorney, Agent, or Firm*—Allan R. Fowler

[57] ABSTRACT

An automatic gun comprises a barrel, a receiver connected to the barrel and a bolt and bolt carrier mounted in the receiver for recoil and counterrecoil movement between the barrel breech and a recoil position rearwardly of a shell pick up position and a casing ejection port. The bolt carrier has a cam track formed along it and the bolt has a pivotally mounted casing extractor and an ejection recess in an opposite region. The forward end of a cam follower is pivotally mounted to the receiver forwardly of the pick up position. The follower has a pair of belt feeding pawls mounted centrally, an inwardly-directed ejection tip at the rearward end and a cam track follower in engagement with the bolt carrier cam track. A belt feeding adaptor is detachably connected to the receiver above the cam follower for receiving an ammunition belt. In response to forward bolt carrier movement, the cam follower is pivoted outwardly, moving the feed pawls into engagement with a belted shell outboard of the pick up position. Corresponding forward bolt movement strips a shell from the pick up position and loads it into the breech. When the bolt carrier recoils after firing, the cam follower pivots inwardly and the feed pawls advance the belt one shell position. As the cam follower pivots inwardly, its ejection tip moves into the ejection recess in the bolt and causes ejection of a shell casing held to the bolt face by the extractor. An ammunition clip adapator is interchageable with the belt feeding adapter.

22 Claims, 7 Drawing Sheets

10
12
14
16
18
20
22
30
32
34
36
40
46
48
50
52
60
106
108
142
147
150
168
370
372

46
200
212
214
224
226
220
222
266
268
168
14
296
116
336
334
270
34a
12
348
350
275
360
272
274
362

CONVERTIBLE, BELT/CLIP-FED AUTOMATIC GUN WITH POSITIVE SHELL CASING EJECTION

BACKGROUND OF THE INVENTION

1. Field of the Invention

The present invention relates generally to the field of automatic guns and more particularly to light machine guns having the capability for alternatively firing belted and clip-fed ammunition.

2. Background Discussion

In spite of the development of such sophisticated and powerful weapons as nuclear bombs, ballistic and guided missles, supersonic fighters and bombers, super aircraft carriers and nuclear-powered submarines, modern military conflicts still ultimately rely upon foot troops whose combat role is, as it has always been, to take and hold ground. This apparent anomoly has been demonstrated time and time again in post-World War II conflicts, including the Korean war, Viet Nam, Granada and the current Iraq-Iran conflict in the Mid-East.

For several hundred years, the primary weapon of ground troops has been the rifle. Starting with crude, single shot, match-lock muzzle loaders, the rifle has evolved through breech-loaders and semi-automatic rifles, into the present day, relatively small calibre, clip-fed. automatic rifles, exemplified in the United States and many other free countries of the world by the M-16 and in Soviet-block countries by the AK-47.

In most military organizations, rifles have typically been supplemented, on a company, platoon or squad level, by submachine guns (which fire pistol ammunition) and light machine guns (which fire rifle ammunition). By way of example, in both World War II and Korea, the semi-automatic M1 rifle used by U.S. troops was augmented by such automatic weapons as the Thompson submachine gun, the "grease" gun, the Browning automatic rifle (BAR) and 30 and 50 calibre machine guns, and in Viet Nam the M-16 was, for example, augmented by the larger, NATO calibre M-60 machine gun.

Many modern automatic rifles, such as the M-16 and the AK-47, as well as various other similar rifles in service throughout the world, combine features which were once separately found in rifles, submachine guns and light machine guns. The resulting modern rifles, which are usually selectable between semi-automatic and fully automatic firing, are sometimes referred to generically as "assault rifles."

Although modern automatic rifles usually have many advantages over those used in World War II and Korea, being generally lighter in weight and having greatly increased fire power, improvements are still continually sought by the military services not only in automatic rifles but also in ligth machine guns (LMG) which are easily carried by troops and which increase the fire-power and effectiveness of the troops in both offensive and defensive situations.

One relatively recent requirement, at least by the military in this country, for new generation LMG's is that such weapons have the dual capability for firing both belted ammunition and ammunition held in conventional, rifle clips. The use of belted ammunition, which is, in one configuration, held in boxes which attach to the gun, enables sustained firing without reloading the gun. On the other hand, the ability to use standard rifle clips which hold the same calibre ammunition and which are commonly available in rifle companies using the LMG's, enables continued operation of the LMG if the supply of belted ammunition is exhausted.

Although some types of belt and clip-fed, "convertible" LMG's have been put into limited service, that does not necessarily mean that such guns are entirely satisfactory for combat use or that they cannot or should not be improved upon. Extensive, individualized "gunsmithing" is, for example, reportedly required on some types of convetable LMG's before they are capable of satisfactory operation even in benign environments. This raises questions as to the reliability of such guns in service and especially under combat conditions, and improvements to overcome this apparent manufacturability problem are expected to be needed.

It is desirable in such convertible guns to reduce the number of small and/or complicated parts. Complicated parts are not only costly to manufacture but often make the interchageability of parts difficult.

Among other requirements, LMG's should: (i) be rugged and operate reliably and accurately, in a wide range of hostile environments, including arid and sandy deserts, humid jungles and icy polar regions, (ii) be capable of taking all manner of abuse and still operate satisfactorily; (iii) not require excessive maintanance and whatever maintenance is required should be quick and simple to perform both under adverse field conditions and by relatively untrained troops, (iv) not have an excessive number of complicated parts which can be easily damaged or which cannot be interchanged among weapons of the same type, (v) be easy to operate accurately by relatively green troops, and (vi) be relatively simple and economical to manufacture.

The importance of this country's having the best possible weapons, including LMG's, for its troops is made evident by the fact that in any armed conflict, United States troops can be expected to be out numbered by enemy troops, often by a large margin. It is, therefore, a principle objective of the present invention to provide an improved, convertible belt/clip-fed automatic gun or LMG which will overcome the deficiencies of known guns of such type.

SUMMARY OF THE INVENTION

In accordance with the present invention, a convertible, belt/clip-fed automatic gun, such as a light machine gun, comprises a barrel having a breech and a receiver connected to the barrel and having a battery position disposed adjacent the barrel breech, a shell pick up position and a shell casing ejection port. A bolt assembly, comprising a bolt and a bolt carrier, is slidably mounted in the receiver for reciprocating movement, in response to firing of the gun, between the battery position and a recoil position rearwardly of the shell pick up position and the shell casing ejection port. The bolt assembly includes means for picking up a shell from the pick up position upon forward bolt assembly movement, for loading the picked up shell into the breach and, after firing, for extracting the fired shell casing and ejecting it outwardly through the ejection port upon rearward recoil movement from the breech towards the recoil position.

Further comprising the gun are ammunition belt receiving and advancing or feeding means which include a cam follower pivotally mounted to the receiver, at least one belt advancing pawl mounted to the cam follower, a belt feeding adapter for receiving an ammunition belt and means for releasably attaching the belt feeding adapter to the receiver adjacent to the shell pick up position and in an operative relationship with the cam follower. The cam follower has a portion thereof in movable engagement with a cam track formed on the bolt assembly, preferably on the bolt carrier, the cam follower being shaped so that upon rearward movement of the bolt assembly (and thus, the cam track) from the breech to the recoil position, for example, by a firing of the gun, the belt advancing pawl is moved inwardly towards the bore axis to inwardly advance, by one shell position, an ammunition belt held by the belt feeding adapter in a manner moving a shell held in the belt into the shell pick up position. The cam follower is also responsive to forward movement of the bolt assembly from the recoil position to the breech for moving the belt advancing pawl a shell distance outwardly in readiness for advancing the belt the next time the bolt assembly is moved rearwardly to the recoil position.

The bolt assembly includes a shell extractor and an ejector recess in a region opposite the extractor. The cam follower includes a shell ejector portion which is caused by the bolt carrier cam, responsive to the bolt assembly moving rearwardly from the the breech to the recoil position and pivoting of the cam follower, to move into the ejector recess and cause ejection of a shell casing held by the shell extractor as the bolt assembly continues to recoil rearwardly to a preestablished position relative to the shell ejection port.

There is also included as part of the gun an ammunition clip holder and means for releasably attaching the clip holder to the receiver in place of the belt feeding adapter and out of engagement with the belt advancing pawl. The clip holder is preferably constructed to receive and feed shells from a conventional rifle clip and for holding the clip directed upwardly and at an angle relative to a vertical plane through the bore axis which does not interfere with use of the gun sights.

According to a preferred embodiment of the invention, the belt feeding adapter includes at least one shell anti-back up pawl for preventing a shell in the pick up position from being moved outwardly away from said position when the belt advancing pawl is moved outwardly in response to forward movement of the bolt assembly.

It is preferred that the cam follower be pivotally mounted at a forward region to the receiver and that the cam track engaging portion be rearward of the pivotal mounting region. Also, it is preferred that the belt advancing pawl is pivotally mounted to the cam follower and is spring-loaded so that when the cam follower is pivoted outwardly, in response to forward movement of the bolt assembly, the pawl pivots to a retracted position as the pawl is pushed outwardly under a shell in the belt to a position which enables the pawl to advnce the belt one shell position when the cam follower is next pivoted inwardly in response to the bolt assembly moving back rearwardly from the breech.

In the preferred embodiment, the belt feeding adapter comprises a lower, body portion and an upper, cover portion, the body and cover portions being hinged together so that the cover porton can be opened relative to the body portion without detaching the adapter from the receiver, an ammunition belt being insertable in the adapter when the coverportion is open and being retained in the adapter when the cover portion is then closed.

BRIEF DESCRIPTION OF THE DRAWINGS

The present invention can be more readily understood from the following detailed description when taken in conjunction with the accompanying drawings. It is to be noted that for purposes of showing important features of the convertible gun of the present invention, the gun is pointing to the left in FIG. 1 and is pointing to the right in the rest of the FIGS. In the accompanying drawings.

DESCRIPTION OF THE PREFERRED EMBODIMENT

Figures 1, 1A, 1B:
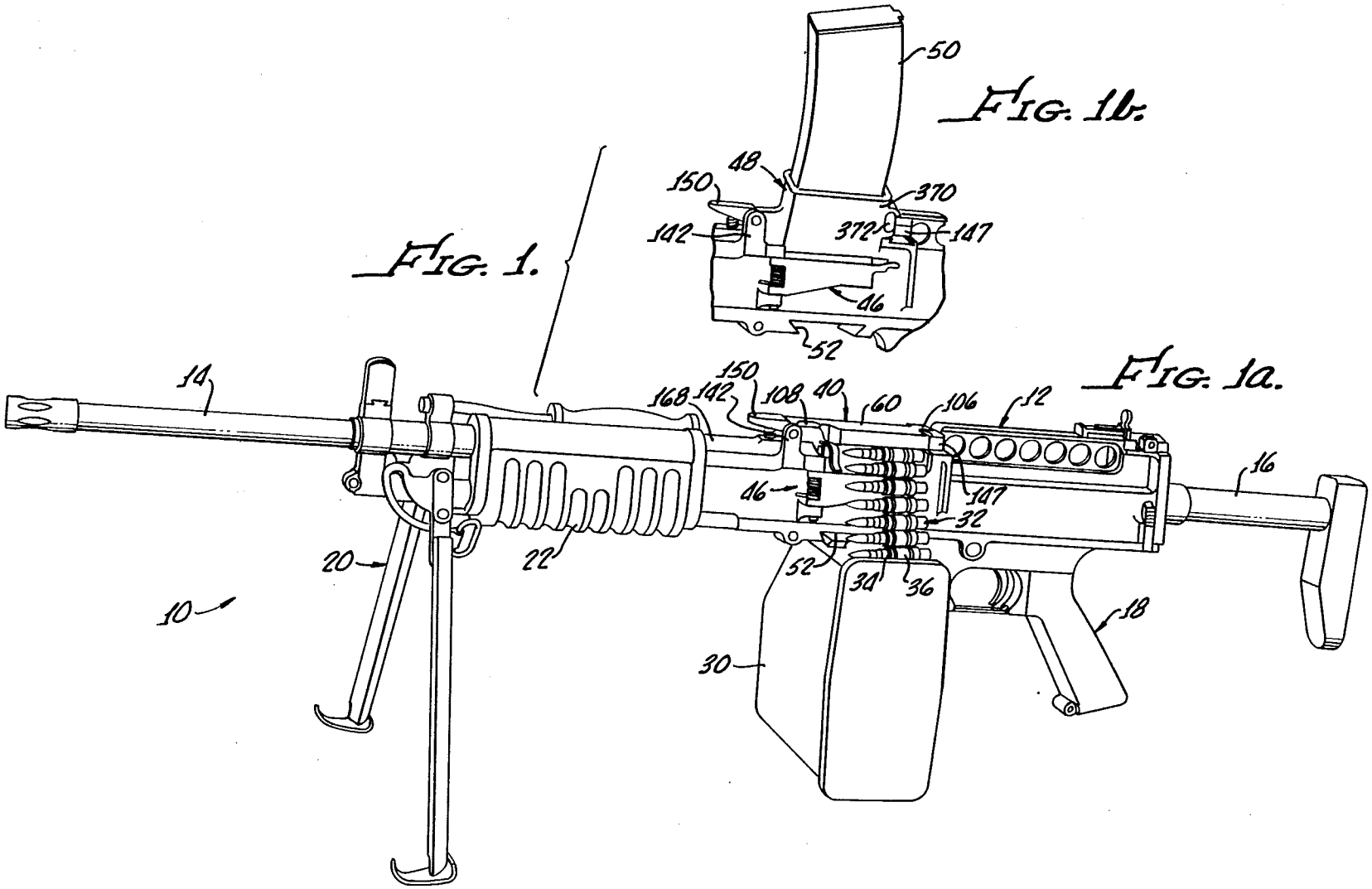
FIG. 1 is an exploded perspective of a convertible belt/clip-fed automatic gun (LMG) in accordance with the present invention, FIG. 1*a* showing the belt feeding configuration of the gun, and FIG. 1*b* showing the relative portion of the gun alternatively configured for feeding ammunition to the gun from a conventional automatic rifle clip.

Illustrated in FIG. 1*a* is an examplary light machine gun (LMG) 10 in which the present invention may be used to advantage. Shown comprising gun 10 is a receiver 12 to which a barrrel 14 is connected. A collapsible shoulder member or stock 16 projects rearwardly from receiver 12 and a conventional pistol grip-type handle and trigger group 18 are connected to lower, rear regions of the receiver. A bipod assembly 20, for example, of the type used on an M-60 machine gun, is connected to rearward regions of barrel 14. Just rearwardly of bipod assembly 20 is a hand guard-grip assembly 22 which encloses rearward regions of barrel 14 and/or forward regions of receiver 12.

Detachable connected to the bottom of receiver 12, forwardly of handle and trigger group 17, is a box magazine 30 which holds a flexible belt 32 of ammunition (i.e., shells) 34 for gun 10. Ammunition belt 32 is of the disintegrating link type in which adjacent links 36 are interlocked by shells 34, the stripping of shells causing the links to separate so they can be separately discharged from gun 10, as described below.

In accordance with the present invention, and as described below, an ammunition belt adapter assembly 40 is detachably connected to the lefthand side (as shown in FIG. 1) of receiver 12 for enabling the firing by gun 10 of shells 34 from belt 32. Shown in operative relationship with belt adapter assembly 40 is a cam follower assembly 46 which provides not only for the advancing of ammunition belt 32 into gun 10, so that shells 34 held by the belt can be fired, but also for the ejection of fired shell casings through the other side of receiver 12, as described below.

Although gun 10 is, as a light machine gun, primarily intented for firing belted ammunition, as is enabled by belt adapter assembly 40 and cam follower assembly 46, emergency situations may arise during combat in which supplies of belted ammunition for the gun may run out. In order to enable continued operation of gun 10 in such situations, albeit with reduced fire power, there is included the provision for alternatively using standard rifle ammunition clips which may, in some situations, be more plentiful than belted ammunition. Accordingly, as depicted in FIG. 1*b*, which shows only shell feeding regions of gun 10, ammunition belt adapter 40 may be substituted, also as more particularly described below, by a clip feeding adapter assembly 48 which then permits the firing by the gun of shells held in a conventional rifle clip or magazine 50. By way of example, assuming that gun 10 is configured for firing standard 5.56 mm (i.e., 223 calibre) ammunition which is used in the M-16 rifle, clip adapter assembly 48 is preferably configured for receiving a standard M-16 clip 50. As can be seen from FIG. 1*b*, when belt adapter 40 is replaced by clip adapter 48, box magazine 30 is removed from a dovetail slot 52 in receiver 12. Also, parts of cam follower assembly 46 are, as described below, removed to accomodate clip feeding adapter assembly 50.

Figure 2:
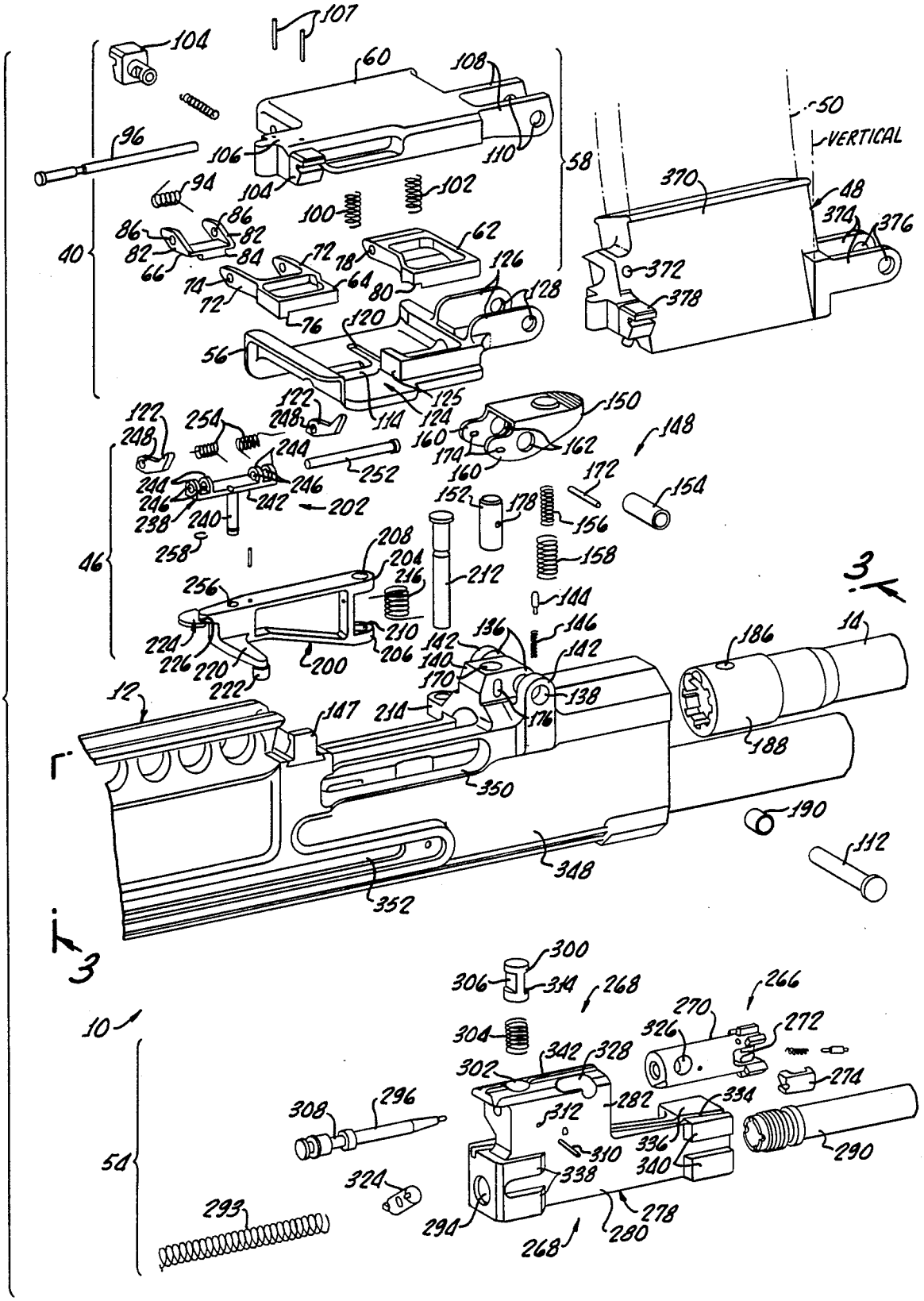
FIG. 2 is an exploded perspective drawing of ammunition feeding and casing ejection regions of the convertible gun shown in FIG. 1, showing the bolt group (i.e., the bolt and bolt carrier), portions of the receiver and barrel and showing both the belt feeding adapter and the rifle clip feeding adapter.

FIG. 2 shows, in exploded perspective, relevant shell feeding and ejecting regions of gun 10 to which belt and clip adapter assemblies 40 and 48, respectively, are detachably connected. Shown in FIG. 2, in addition to forward regions of receiver 12 and rearward regions of barrel 14, are belt adapter assembly 40, clip adapter assembly 48, cam follower assembly 46 and a bolt group 54.

It is to be noted that in FIG. 2 and subsequent FIGS. gun 10 is pointing to the right; whereas, in order to show features not otherwise clearly visible, FIGS. 1*a* and 1*b* depict the gun pointing to the left.

Principally comprising ammunition belt adaptor assembly 40, as shown in FIG. 2, are an adaptor base 56 and a cover assembly 58. In turn comprising cover assembly 58 are a upwardly recessed cover plate 60, a shell stripper 62, a shell pusher 64 and a shell holding or anti-back up pawl 66. Shell pusher 64 is formed having a pair of similar, longitudinally spaced apart, outwardly directed ears 72 through which are formed a pair of longitudinally aligned mounting apertures 74. Formed along the rearward edge of shell pusher 64 is a downwardly projecting, wedge-shaped shell pushing portion 76. Shell stripper 62 is generally square in plan view and has a mounting aperture 78 formed longitudinally through an outer end region thereof. Formed upwardly into shell stripper 62, at a inner, rearwardly corner of the stripper is a recess 80 which receives forward regions of belt links 36 when a shell 34 is being stripped out of ammunition belt 32 during firing of gun 10 and holds the link in place (i.e., prevents forward movement of the link as the shell is pushed forwardly during the stripping operation). Anti-back up pawl 66 is formed having a pair of outwardly projecting, longitudinally spaced apart, parallel ears 82 interconnected at inner end by a pawl portion 84. A pair of longitudinally aligned mounting apertures 86 are formed through outer end regions of ears 82. Upon assembly, anti-back up pawl 66 is positioned between shell pusher ears 72 with mounting apertures 86 and 74 aligned, and with a coil-type torsion spring between pawl ears 82.

Figure 3:
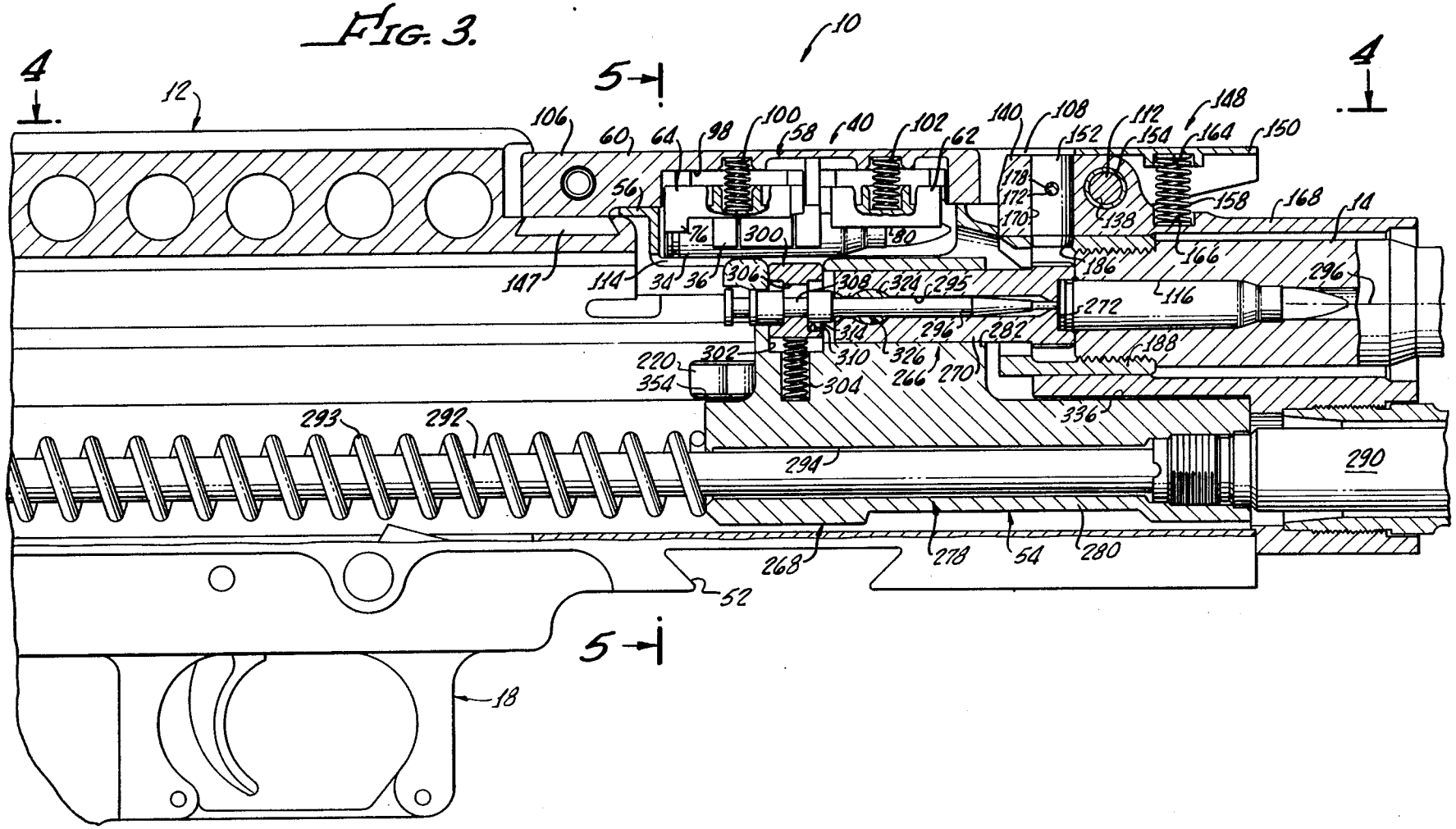
FIG. 3 is a longitudinal cross sectional view taken along line 3—3 of FIG. 2 (assuming the parts shown in exploded perspective in FIG. 2 are assembled together in their proper relationship), showing the gun at an instant in time in which the bolt group is at the breech with a shell in the breech and showing the belt feeding adapter installed on the receiver.
Figure 5:
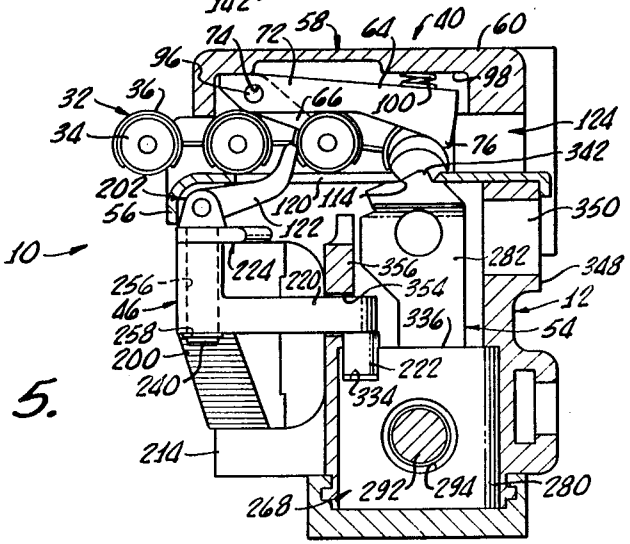
FIG. 5 is a transverse cross sectional drawing taken along line 5—5 of FIG. 3 showing, in particular, a belt advancing feed pawl (connected to the belt feeding cam follower) in an outermost position in readiness for advancing a next shell in the belt to the shell pick up position when the bolt group moves rearwardly in recoil after firing the shell chambered in the breech.

An elongate pin 96, extends longitudinally through apertures (not shown) in cover plate 60 and through shell pusher apertures 74, pawl apertures 86, spring 94 and stripper apertures 78. Pin 96 pivotly mounts shell pusher 64 and stripper 62 in a side-by-side relationship, with the stripper forwardly of the pusher and with anti-back up pawl 66 between pusher ears 72, within a rectangular recess formed upwardly into cover plate 60 and defined by an under surface 98 (FIGS. 3 and 5). Compression springs 100 and 102, installed between inner end regions of shell pusher 64 and shell stripper 62, respectively, and cover plate under surface 98, when the shell holder and stipper are installed on pin 96, urge inner end regions of the pusher and stripper downwardly. Such downward pivoting is limited by the upper surfaces of outer ends of shell pusher 64 and stripper 62 bearing against cover under surface 98.

Further comprising cover assembly 58 (still referring to FIG. 2) are two opposing, spring loaded cover latches 104 which project sidewardly in opposite directions from a rearward end region 106 of cover 60. Latches 104 are retained in end region 106 by a pair of vertical pins 107. Projecting forwardly from cover 60, and forming part thereof, are a two similar, laterally spaced apart arms 108, by means of which the cover assembly is attached to receiver 12. A pair of laterally aligned attaching apertures 110 are formed through forward end regions of arms 108 for receiving a removable mounting pin 112, as described below.

Ammunition belt adapter base 56 is configured to mate with cover assembly 58, described above, so that ammunition belt 32 (FIG. 1*a*) cam be fed therebetween from magazine 30 into gun 10. A recessed bottom region of base 56 is formed having a longitudinal shell feeding slot 114 which is narrower in rearward regions than in forward regions, the forward regions being sufficiently wide to permit a shell 34 being stripped forwardly from ammunition belt 32 to move downwardly through the slot and into a shell chamber 116 (FIG. 3) formed in the barrel 14 at the breech. Rearward regions of feeding slot 114 are narrower than a shell width so that shells 34 moved into a shell pick up position 118 (FIG. 6, 8) at the slot are supported by adapter base regions on both sides of the slot. Two longitudinally spaced apart, lateral slots 120 (only a forward one of which is shown in FIG. 2) are formed in the botton of base 56, from shell feed slot 114 outwardly, to provide cleareance for a pair of belt advancing pawls 122, which, as described below, comprise part of cam follower assembly 36.

A rectangular, belt link ejection port 124 is defined in an inboard side edge 126 of base 56 to enable the discharge of belt links 36 after a shell 34 has been stripped from the link which is at feed slot 114. Projecting forwardly from adapter base 56 and forming a part thereof are two laterally spaced apart mounting arms 126 having mounting apertures 128 formed therein for receiving mounting pin 112. Upon attachment of belt feeding adapter 40 to receiver 12, arms 108 of cover 60 fit inside of arms 126 of base 56 and such arms slide downwadly into slots 136 in upper forward regions of the receiver until the apertures 110 and 128 in respective arms 108 and 126 are aligned with a mating transverse aperture 138 formed through a receiver boss 140 and side ears 142 defined by slots 136. Pin 112 is then inserted laterally through apertures 130, 128 and 110, the pin being thereafter locked in place, as by the use of a detent pin 144 having a spring 146. When pin 112 is removed cover assembly 58 and base 56 can be removed as two pieces. When adapter base 56 and cover assembly 58 are pivoted closed on pin 112, latches 104 on cover 60 snap into a latching member 147 mounted on receiver 12 (FIG. 2).

As shown in FIGS. 2 and 3, a barrel lock assembly 148 may advantageously also be installed on pin 112. Comprising barrel lock assembly are an operating lever 150, a barrel locking pin 152 a tubular bushing 154 and concentric compression springs 156 and 158. Lever 150 is formed having two, laterally spaced apart, depending legs 160, each of which has a mounting aperture 162 formed therethrough. When lock assembly 148 is attached to receiver 12, legs 160 straddle boss 140 and extend downwardly into slots 136 on either side of the boss. Bushing 154 is inserted, through an outer aperture 138 in righthand side ear 142, into the corresponding aperture in boss 140 and through lever leg apertures 162.

In the above-described manner, lever 150 is locked to boss 140 and can pivot on bushing 154 which has clearance relative to the boss aperture. Upper ends of compression springs 156 and 158 are received into a shallow pocket 164 (FIG. 3) formed on the under side of lever 150 forwardly of mounting pin 112. Lower ends of springs 156 and 158 are received in a shallow recess 166 formed into a forward end region 168 of receiver 12. Barrel locking pin 152 is installed in a vertical aperture 170 formed downwarly through boss 140. Locking pin is fixed to lever legs 160 by a transverse pin 172 which extends through apertures 174 in legs 160 rearwardly of apertures 162, through a vertically elongated slot 176, which extends transversely through boss 140 in the region of aperture 170, and through a transverse aperture 178 through locking pin 152. When so installed, springs 156 and 158 urge the lower end of locking pin 152 into an aperture 186 (FIG. 3) in a tubular bolt locking ring 188 threaded onto the reaward end of barrel 14, assuming, of course, that the barrel and locking ring are porperly oriented relative to the locking pin.

When barrel locking assembly 148 is installed in the above described manner, a bushing 190 (FIG. 2) is installed in the side ear aperture 138 through which bushing 154 is installed so that pin 112 fits properly.

Cam follower assembly 46 (FIG. 2) principally comprises a cam follower member 200 and a belt (shell) advancing pawl assembly 202. Cam follower member 200 is formed having upper and lower mounting ears 204 and 206, respectively, at the forward end. Mounting apertures 208 and 210 are formed, in vertical alignment, through respective mounting ears 204 and 206 for receiving a mounting pivot pin 212. A pair of mating mounting lugs 214 project outwardly from the lefthand side of receiver 12 rearwardly adjacent to receiver side ears 142 (FIGS. 4 and 5) between which upper and lower ears 204 and 206, respectively, of cam follower member 200 fit and through which adapter mounting pin 112 is also installed to thereby pivotally attach cam follower assembly 46 to receiver 12. A coil torsion spring 216 installed on pin 112 between cam follower member ears 204 and 206 urges the member to pivot about the pin in an inward direction (in the direction of arrow "A", FIG. 4).

Figure 4:
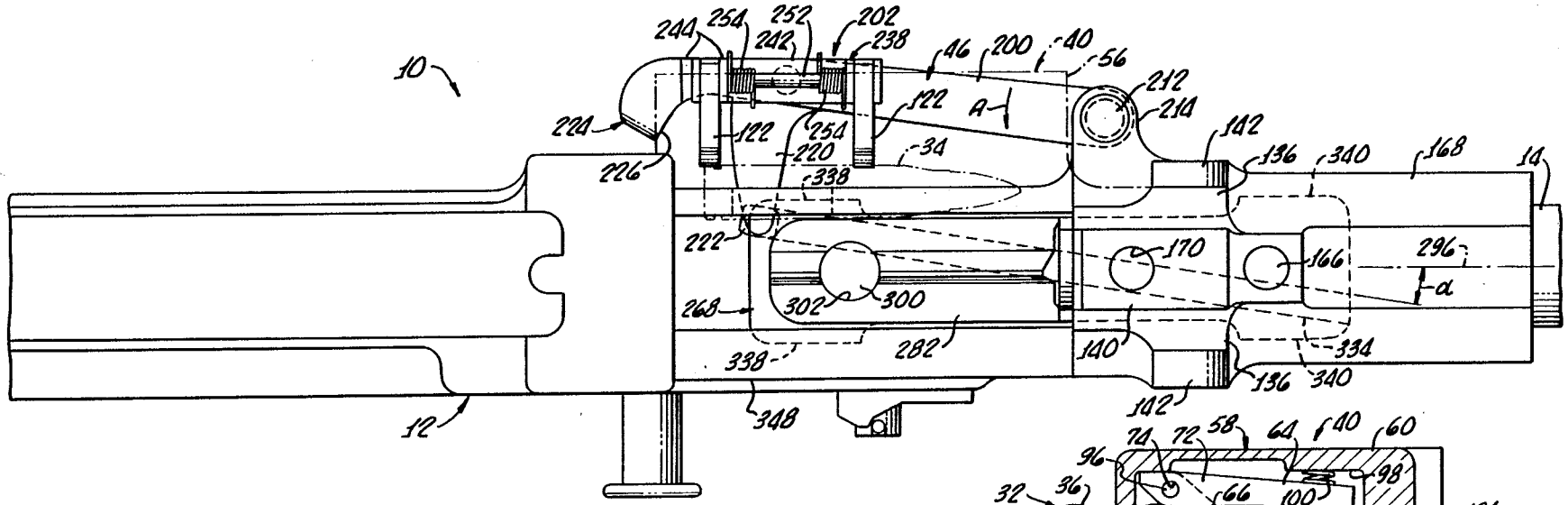
FIG. 4 is a plan view taken along line 4—4 of FIG. 3, but with the belt feeding adapter removed, showing the outwardly pivoted position of a belt feeding cam follower mounted on the receiver at the same instant in time as FIG. 3, with the bolt group still at the breech.

Projecting inwardly from a reawardly end region of cam follower member 200 is a cam follower arm 220 (FIGS. 2, 4 and 5). Pivotally mounted to the inboard, distal end of cam follower arm 220 is a depending cam follower element 222. A reaward end of cam follower member is curverd inwardly to form a shell casing ejector 224 having a flat, forwardly directed, casing ejector face 226 (FIG. 4).

Comprising belt advancing pawl assembly 202 (FIGS. 2, 4 and 5) is a T-shaped member 238 comprising a depending pivot pin 240 and an elongate arm 242 fixed to the top thereof. Two pairs of pawl mounting ears 244 project upwardly from the top of arm 242, one pair of ears being at each end of the arm in a longitudinally spaced apart relationship. Pawl mounting apertures 246 are formed in ears 244 and correspondig apertures 248 are formed through the outboard end of each pawl 122. With both pawls 122 pointing inardly (FIG. 5) and one pawl inserted between each pair of ears 244, the pawls are pivotally mounted to member 238 by a mounting pin 252 which extends rearwardly through all of apertures 246 and 248 and is retained in place by a detent (not shown). Torsion coil springs mounted on pin 252, between pawls 122, urge inboard ends of the pawls upwardly (FIG. 5). Lower surface regions of pawls 122 beneath mounting pin 252 bear against an upper surface of arm 242 and limit pivotal movement of the pawls.

Pivot pin 240 connects pawl assembly 202 to cam follower member 200, the pin being downwardly received through an aperture 256 formed vertically through the member about ⅔ of the distance rearwardly from member mounting pin 212 toward the ejector tip 224. A conventional C-ring 258 (FIG. 2) may be used to retain pivot pin 240 in cam follower member 200. When pawls 122 are installed in the above described manner, they curve upwardly and inwardly (FIG. 5) so as to bear against a shell 34 in ammunition belt 32.

Figure 7:
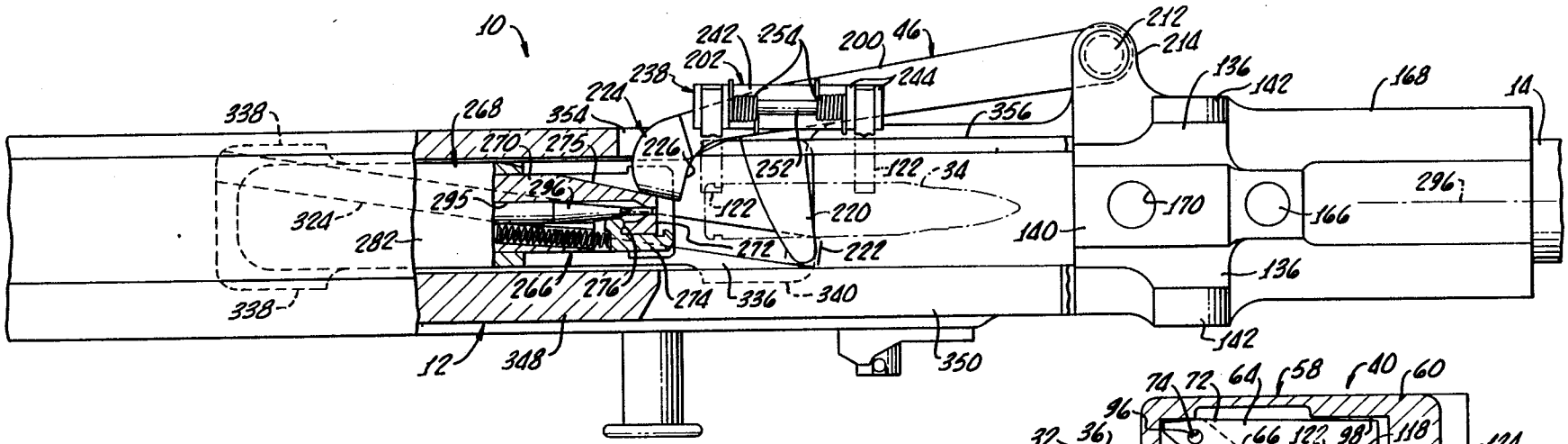
FIG. 7 is a plan view of the gun similar to FIG. 4, but showing the inwardly pivoted position of the belt feeding cam follower at the instant of time of FIG. 6 when the bolt group has recoiler to a rearward position.
Figure 8:
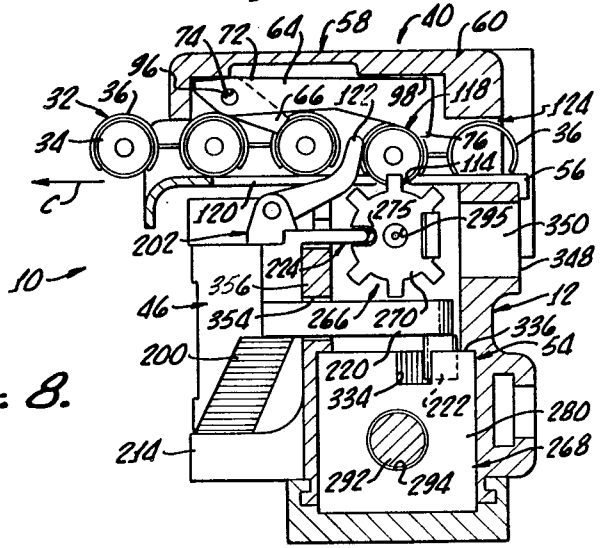
FIG. 8 is a transverse cross sectional drawing similar to FIG. 5 but at the instant of time of FIG. 6 when the bolt group has recoiled to a rearward position, and showing the belt advancing pawl in its innermost position in which it has just moved a belted shell into the pick up position in readiness to be picked up by the bolt when the bolt group moves back forwardly to the breech.

Bolt group 54 (FIG. 2) comprises generally a bolt assembly 266 and a bolt carrier assembly 268. Bolt assembly 266 is mounted to bolt carrier assembly 268 in a generally conventional manner so that limited axial movement between them is permitted. In turn comprising bolt assembly is a bolt 270 having a forward face 272 (FIGS. 2 and 3) and a spring-loaded, shell casing extractor 274 mounted by a semi-cylindrical pivot ridge 276 engaging a mating semi-cylindrical groove within recess 275 adjacent such forward face (FIGS. 7 and 9). An ejection recess 275 is cut into bolt 270 opposite to casing extractor 274.

Bolt carrier assembly 268 comprises a generally L-shaped carrier 278 having an elongate lower portion 280 and a shorter upper portion 282. Connected to a forward end region of carrier lower portion 280 is a forwardly directed, gas operated push rod. A rearwardly directed, elongate recoil rod 292 extends through a longitudinal aperture 294 in carrier lower portion 280 in axial alignment with push rod 290. Mounted around recoil rod 290, rearwardly of carrier 268, is a long recoil spring 293.

Longitudinally mounted in an aperture 295 formed axially through carrier upper portion 282 along a barrel bore axis 296 (FIGS. 2 and 3) is an elongate firing pin 298 which is held in aperture 295 by an I-shaped locking element 300 which is installed downwardly into a circular aperture 302 in carrier upper portion 282 on top of a compression spring 304. When locking element 300 is pushed downwardly against spring 304, firing pin 296 is inserted through an aligned aperture 306 in the element. Then, when element 300 is released, spring 304 pushes the element upwardly so that portions of the element adjacent aperture 306 engage a groove 308 around rearward regions of the firing pin, thereby locking the firing pin in carrier upper portion 282. Although locking element 300 is thereby held in aperture 302 by firing pin 296, if the firing pin has to be repolaced, the element will be loose unless otherwise retained. For such retaining purpose, a slender, transverse pin 310 is installed in a transverse aperture 312 formed through carrier upper portion 282 in the region of locking pin aperture 306. When inserted in aperture 312, pin 310 is received in a recess 314 in a forward side of locking element 300. As a result, firing pin 296 can be removed without removing locking pin 312. Forward regions of firing pin 296 are received into a bore axis aperture formed through bolt 270 when bolt assembly 266 and carrier assembly 268 are assembled together.

Bolt assembly 266 is connected to carrier assembly 268 by a transverse camming pin 324 which is received in a recess 326 in bolt 270 and which extends into a flat L-shaped camming aperture formed through the inboard side of carrier upper portion 282. Camming pin 324 and camming aperture 328 permit limited axial movement of bolt assembly 266 relative to carrier assembly 268 and permit the bolt assembly to rotate a partial turn so that the bolt assembly can be locked to a breech locking ring 188 (FIG. 2) when the bolt and carrier assemblies are driven forwardly, by recoil spring 293, into their forwardmost, battery position.

Importantly, as shown in FIGS. 2, 4, 5, 7 and 8, a substantially linear cam track 334 is formed downwardly into carrier lower portion 280 from an upper surface 336 thereof. Cam track 334 is angled outwardly and rearwardly at an angle, $\alpha$, with respect to barrel bore axis 296 (FIG. 4). Preferably angle, $\alpha$, is between about 5° and about 10°, and is more preferably about 6°. The depth and width of cam track 334 are selected so that cam track follower element 222 slides freely along the track (FIG. 5).

Figure 6:
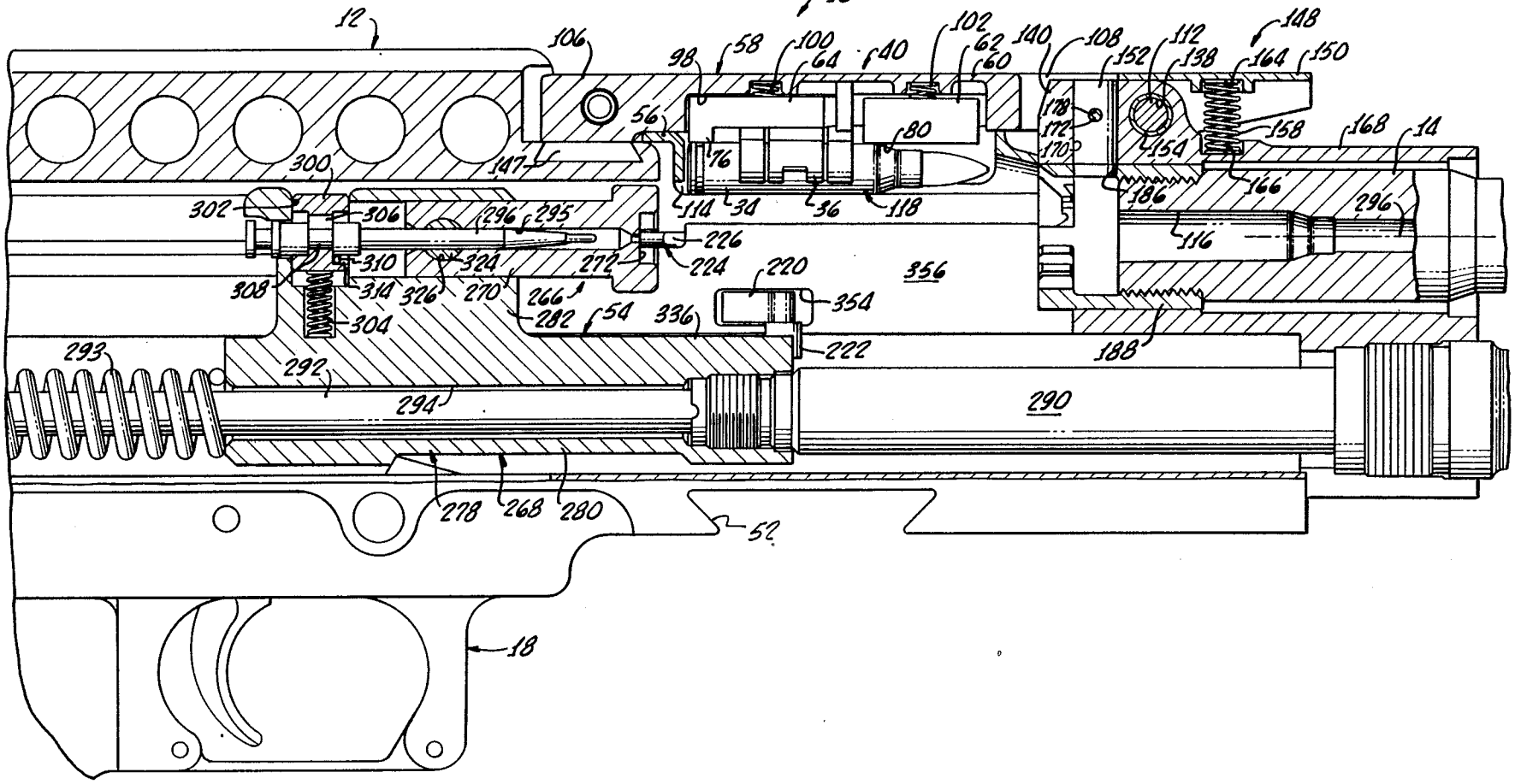
FIG. 6 is a longitudinal cross sectional drawing similar to the view of FIG. 3, but showing the internal configuration of the receiver region of the gun at a later instant in time when the bolt group has recoiler fully rearward after firing the shell previously chambered in the breech.

Bolt group 54 is installed in receiver 12 for axial sliding movement between a forwardmost battery position (FIG. 3) and a rearward, recoil position (FIG. 6). This rearward, recoil position of bolt group 54 may, however, vary depending upon many factors including characteristics of the ammumition fired (which determine recoil forces), temperature of gun 10, amount of wear of the moving parts of the gun, and the amount of lubrication and dirt present in the gun. Guides, such as guides 338, 340 and 342 (FIG. 2) on bolt carrier assembly 268 and mating, longitudinal guideways (not shown) along the inside of receiver 12 guide the reciprocating movement of bolt group 54 in the receiver.

Formed through a righthand side wall 348 of receiver 12, opposite cam follower member 200 (FIGS. 2 and 5) is an axially elongate shell casing ejection port 350. Below and rearwardly of ejection port 350 is an axially elongate charger slot 352 through which, upon assembly of gun 10, a charging lever (not shown) outwardly projects. An axially elongated cam follower slot 354 is formed in a lefthand side wall 356 of receiver 12 to enable the insertion of cam follower arm 220 though such side wall and into engagement with bolt carrier cam track 334. Furthermore, receiver 12 is open at the top in the region of belt feeding adapter assembly 40 (FIG. 2).

ASSEMBLY

The assembly of gun 10 for firing shells 34 from ammunition belt 32 is generally apparent from the above description. By way of brief summary, however, bolt group 54 is installed in receiver 12 and barrel 14 is inserted in receiver forward region 168 (FIGS. 2 and 3). Barrel lock assembly 148 is assembled as described above and is pivotally mounted to receiver boss 140 by bushing 154 (FIGS. 2 and 3). Barrel 14 is then locked to receiver 12 by locking pin 152.

Cam follower assembly 46, with cam follower arm 220 inserted inwardly through cam follower slot 354 (FIG. 5) in receiver side wall 356 and with cam follower element 222 in bolt carrier cam track 334, is pivotally mounted to receiver lugs 214 by pin 212 (FIG. 2). Belt feeding adapter cover assembly 60 is also assembled as described above with respect to FIG. 2 and, together with adapter base 56, is pivotally mounted, by pin 112, to receiver boss 140 and side ears 142 (straddling barrel lock assembly 148). Cover assembly 60 is then opened relative to base plate 56 and one end of an ammunition belt 32 is inserted between the cover assembly and base, with an end shell 34 at base slot 114 (i.e., at shell pick up position 118). Cover assembly 60 is then closed so that latches 104 snap into member 147 on receiver 12.

OPERATION

FIGS. 3–5 are different views of gun 10 showing the condition of the gun at the instant of firing, with both bolt assembly 266 and bolt carrier assembly 268 in a forwardmost, battery position and with cam follower assembly 46 pivoted to its outermost position, feed pawls 122 being thereby positioned relative to ammunition belt 32 for advancing the belt when the cam follower assembly is pivoted inwardly. In contrast, FIGS. 6–8, which correspond to respective FIGS. 3–5, show the condition of the gun at the instant of full rearward recoil of bolt assembly 266 and carrier assembly 268 (after firing of the gun or upon charging the gun), with cam follower assembly 46 pivoted to its inwardmost position and with feed pawls 122 having advanced a shell 34 held in ammunition belt 32 into shell pick up position 118.

Figures 9A, 9B, 9C, 9D, 9E:
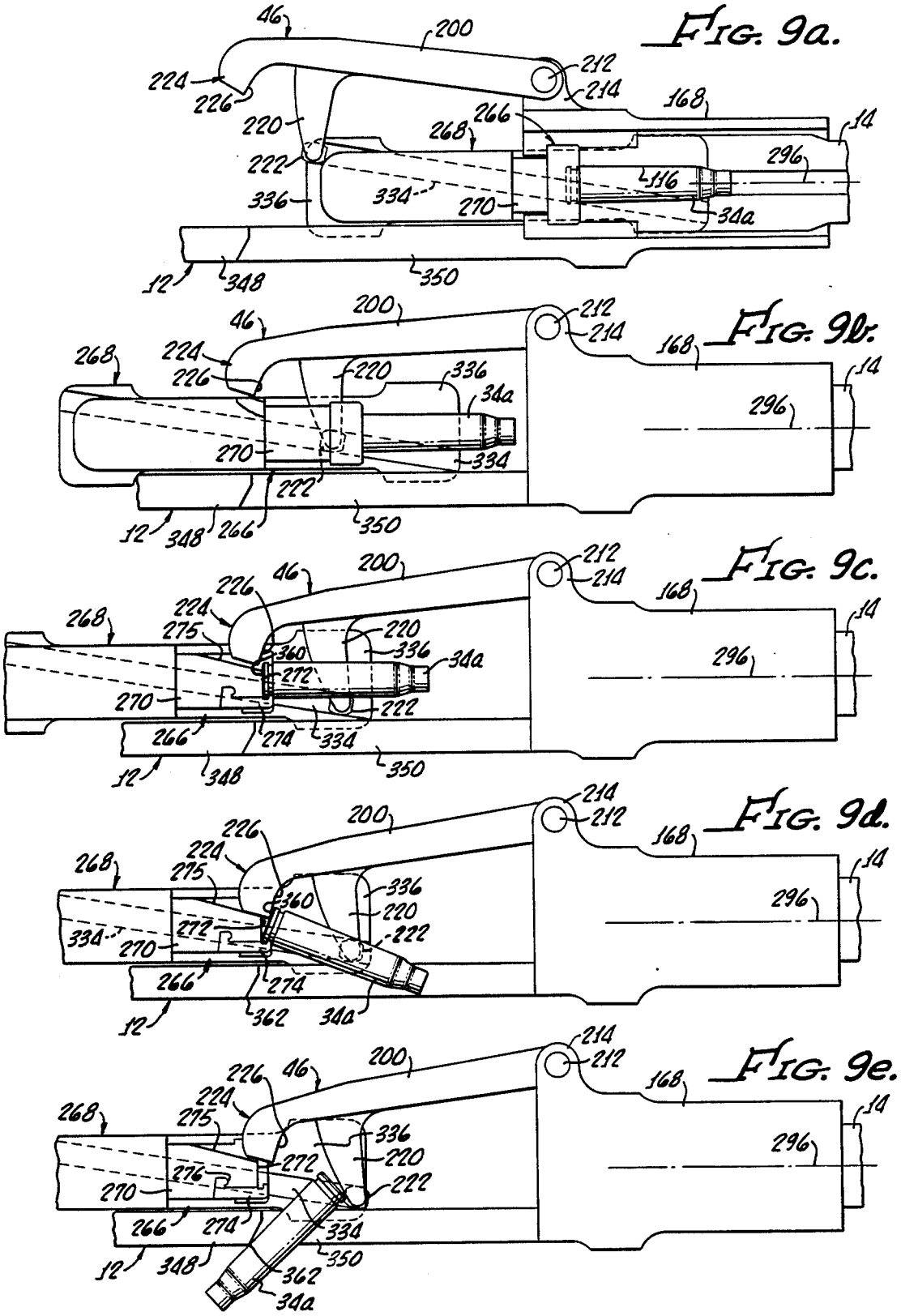
FIG. 9 is a sequence of plan views similar to FIG. 4 and taken at succesive time intervals, showing the belt feeding cam follower and the bolt as the bolt moves rearwardly from the breech, after firing, to its full recoil position and showing the extraction and ejection of a fired shell casing by the bolt, FIG. 9*a* showing the bolt at the breech, a chambered shell and the belt feeding cam follower pivoted to its outermost position, FIG. 9*b* showing the bolt moved slightly rearwardly after firing, thereby starting the extraction of the fired shell casing from the breech and showing the belt feeding cam follower being pivoted inwardly towards a barrel bore axis, FIG. 9*c* showing the bolt recoiled rearwardly with the shell casing extracted from the breech and laterally aligned with a shell ejection port of the receiver and showing the belt advancing cam follower pivoted inwardly towards the bore axis so that a shell ejecting portion of the cam follower has entered a shell ejection recess in the bolt and is in contact with the base of the shell casing being extracted, FIG. 9*d* showing the bolt moved rearwardly relative to the belt feeding cam follower so that the shell ejection portion of the cam follower is forwardly of the bolt and has pushed against the shell casing base so that the casing is pivoting about the shell extractor and is part way out of the ejection port, and FIG. 9*e* showing the bolt recoiled further rearwardly of the belt feeding cam follower and showing the extracted shell casing pivoting out of the ejection port and in contact with a rearward edge of the port which acts as a pivot point.

As more particularly described below, FIG. 9 is a series of simplified diagrams which correspond to time lapse photographs, depicting, in simplified form, the positive shell casing ejection operation of gun 10. FIG. 9*a* starts at the instant in time corresponding to FIGS. 3–5 when bolt and carrier assemblies 266 and 268 are fully forward for firing a chambered shell 34 and cam follower member 200 is pivoted fully outward. FIG. 9*e* ends at the later instant in time corresponding to FIGS. 6–8 when the bolt and carrier assemblies are fully rearward in recoil and the cam follower member is pivoted fully inwardly, causing ejection of a casing 34*a* (of shell 34) outwardly through ejection port 350 as a result of ejector tip 224 of cam follower member entering through ejector recess 275 in bolt 270 and engaging a base 360 of the casing, the casing pivoting about a rearward edge 362 of ejection port 350 and out through the port. FIGS. 9*b*–9*d* depict the shell casing ejection operation at times intermediate those depicted by FIGS. 9*a* and 9*e*.

More specifically, at the instant of firing depicted in FIGS. 3–5 and 9*a*, barrel gas is bled from barrel 14 and may be directed in a conventional manner to a forward face (not shown) of gas piston 290 which is connected to bolt carrier assembly 268. The gas acting on piston 290 starts recoiling carrier assembly 268 rearwardly, thereby causing, by action of camming pin 324 and slot 328, the rotational unlocking of bolt assembly 266 locking ring 188 (FIG. 3). As cam followen element 222 in engagement with bolt carrier cam track 334, rearward recoil movement of carrier assembly 268 causes cam follower assembly 46 to pivot inwardly about pin 212 (direction of arrow "A," FIG. 4). This inward pivoting of cam follower assembly 46 moves shell advancing pawls inwardly towards barrel bore axis 296 (direction of arrow "B," FIG. 5). Continued rearward recoil movement of carrier assembly 268 pulls bolt assembly 266 along in recoil and causes cam follower assembly 46 to continue pivoting inwardly, therby causing pawls 122 to continue the advancing of an endmost shell 34 inwardly towards pickup position 118.

As bolt carrier assembly 268 recoils, recoil spring 293 (FIGS. 2, 3 and 6) is compressed, thereby absorbing recoil energy from bolt group 54 and bringing the bolt group to a stop at a rearmost position when all the recoil energy has been absorbed. In this bolt group rearmost position, depicted in FIGS. 6–8, cam track 334 on bolt carrier 278 has caused cam follower assembly 46 to pivot fully inwardly and has thereby caused belt advancing pawls 122 to inwardly push a shell 34 in belt 32 into pick up position 118 in readiness to be picked up by bolt 270 as bolt group 54 is driven back forwardly in counterrecoil by spring 293.

It can be understood from the foregoing operational description that the complete belt/shell advancing step is performed on the recoil stroke of bolt group 54, unlike some known automatic guns which require some counterrecoil movement of the bolt before the shell advancing step is completed. As a result, according to the present invention, it is assured that a shell 34 is waiting in pick up position 118 when bolt assembly 266 starts forwardly and the possibility that the bolt will counterrecoil to the breech without a shell having been picked up is eliminated.

After bolt assembly 266 has engaged a shell 34 in pick up position 118, continued counterrecoil of the bolt assembly strips the shell out of its belt link 36 and pushes the shell forwardly and downwardly through feed slot 114. Shell pusher portion 76 pushed downwardly on base end regions of shell 34 in pick up position 118, thereby preventing the shell from being underridden by bolt assembly 266 instead of being picked up thereby. As shell 34 is driven forwardly by bolt assembly 266 after pickup, shell pusher 64 urges the shell downwardly through feed slot 114.

After a shell 34 in pick up position 118 has been stripped out of belt 32, the loose link 36 is pushed out of link ejection portion 124 the next time the belt is advanced by pawls 122.

As bolt group 54 counterrecoils forwardly, carrier cam track 334 causes cam follower assembly 46 to pivot outwardly about pin 112, thereby moving belt advancing pawls 122 outwardly (direction of arrow "C," FIG. 8) so that belt 32 can be advanced another shell position when the bolt group next recoils. As belt advancing pawls 122 move outwardly in response to bolt group counterrecoil movement, the pawls retract as then move past (under) the shell 34 that they will push inwardly against in the belt advancing step. Anti-back up pawls 66 (FIGS. 2, 5 and 8) push inwardly on this same shell to prevent the outward movement of belt advancing pawls 122 from backing up ammunition belt 32.

When bolt assembly 266 reaches the breech, carrier assembly 268 still has a short forward distance to travel. Such continued forward movement of bolt carrier assembly 268 first cams bolt assembly 266 through a partial rotation so that the bolt assembly is locked to breech ring 188 (FIG. 8) and then fires the chambered shell by inpacting it with the forward tip of firing pin 296.

As depicted in FIG. 9, recoil movement of bolt carrier assembly 268 after firing also causes the contolled or positive ejection of fired shell casing 34*a* outwardly through casing ejection port 350 in a consistant and reliable manner from firing to firing. In this regard, it has been found that using conventional bolt mounted, spring-loaded ejectors, casing ejection is often erratic and dependent upon bolt recoil velocity which changes as a gun heats up. For example, when firing is initiated and the gun is cold, the firing rate tends to be slow and recoil velocity is relatively low. In this condition, casing ejection tends to be slow and the casing being ejected (with the extractor as a hinge point) tends to "wrap around" the rearward edge of the ejection port, with the center of gravity outside the port, and be ejected backwardly towards the gun operator. However, as the gun get hot and speeds up, the casing being ejected tends to hit the rearward edge of the ejection port with the center of gravity inside the port. When this occurs, the casing can spin back into the gun the cause jamming of the gun. However, with the present configuration of gun 10, casing ejection by cam follower member tip 224 tends to be independent of gun operating speed.

As shown in FIGS. 9a–9c, as cam track 334 moves rearwardly (i.e., as carrier assembly 268 recoils after firing), cam follower member 200 (part of cam follower assembly 46) pivots inwardly, as described above, moving ejection tip inwardly towards bore axis 296 and bolt 270. Casing 34a is extracted and held to the bolt face by bolt-mounted extractor 274. At a preestablished bolt recoil position (FIG. 9c) cam follower member 220 has pivoted inwardly to an extent that ejector tip 224 starts entering ejecting recess 275 at the forward end of bolt 270 opposite extractor 274. As bolt 270 continues recoiling (FIG. 9d), the bolt moves rearwardly of ejection tip 224, with the result that the ejection tip "pushes" the contacted edge region of the casing forwardly (relative to the bolt), causing casing 34a to start pivoting outwardly through ejection port 350. Additional recoil movement of bolt 270 (FIG. 9e) causes ejection tip 224 to pivot casing 34a further out of ejection port 350, the casing being finally released by casing extractor 274 for complete ejection.

Because casing ejection always occurs at the same relative position between bolt 270 and cam follower ejection tip 224, casing ejection is substantially independent of bolt speed and consistant, complete casing ejection is achieved.

CLIP FEEDING OF GUN 10

Ammunition feeding of gun 10 can, as mentioned above and as shown in FIG. 1a, alternatively be by means of clip adapter assembly 48 which is configured to hold a conventional rifle clip 50, for example, an M-16 rifle clip. Comprising clip adapter assembly 48 is a tubular member 370 having a rectangular cross section sized to receive clip 50. Installed in a rearwardly projecting region of member is a conventional clip release assembly 372 of the type ordinarily used with clip 50—for example, an M-16 clip release assembly. Projecting forwardly form member 370 are two parallel, spaced apart attachment arms 374 (FIG. 2), which corresponds to arms 108 of cover assembly 58. Mounting apertures 376, corresponding to cover assembly apertures 110, are formed through arms 374 for receiving mounting pin 112. Extending sidewardly form rearward regions of member 370 are opposing, spring-loaded latch members 378 which correspond to latch members 104 of cover assembly 58.

To install clip adapter assembly 48 to gun 10, assuming belt feeding adapter assembly 40 is already installed on the gun, the belt feeding adapter is detached by releasing latches 104 removing mounting pin 112. Pawl assembly 202 is then removed from cam follower assembly 46 by removing C-ring 258 from pin 240. Clip adapter arms 374 are then inserted in slots 136 and pin 112 is replaced. Clip adapter assembly 48 is then pressed down so that latches engage latch member 147 on receiver 12. A loaded clip 50 is then snapped into member 370.

Thereafter operation of gun with clip feeding is the same as described above for belt feeding, except that sheels are picked up directly from feedlips on clip 50 instead of from ammunition belt 32. Shell pick up position 118 is, however, the same in both cases.

Although there is described above a specific arrangement of a convertible belt/clip-fed automatic gun, with positive shell casing ejection, in accordance with the present invention for the purpose of illustrating the manner in which the invention can be used to advantage, it is to be appreciated that the invention is not limited thereto. Accordingly, any and all variations and modifications which may occur to those skilled in the art are to be considered to be within the scope and spirit of the invention as defined by the appended claims.

What is claimed is:

1. A convertible, belt/clip-fed automatic gun, which comprises:

a. a gun barrel having a breech;

b. a receiver connected to the barrel and having a battery position disposed adjacent said barrel breech, a shell pick up position and a shell casing ejection port;

c. a bolt assembly slidably mounted in the receiver for reciprocating movement, in response to firing of the gun, between the battery position and a recoil position rearwardly of the shell pick up position and the shell casing ejection port, the bolt assembly having means for picking up a shell from the pick up position upon forward bolt assembly movement and for loading the picked up shell into the barrel breech and, after firing, for extracting a fired shell casing from the barrel breech upon rearward recoil movement from the battery position to the recoil position, said bolt assembly having an ammunition belt advancing and shell casing ejection cam track formed thereon;

d. ammunition belt receiving and advancing means, comprising a cam follower pivotally mounted to the receiver, at least one belt advancing pawl mounted to the cam follower, a belt feeding adapter for receiving an ammunition belt and means for releasably attaching said belt feeding adapter to the receiver at a position adjacent to said shell pick up position and in a cooperative relationship with said cam follower;

said cam follower having a cam track following portion thereof in engagement with said bolt assembly cam track and being thereby responsive to rearward movement of the bolt assembly from the breech to the recoil position for causing said belt advancing pawl to inwardly advance an ammunition belt held by the belt feeding adapter in a manner moving a shell in the belt into the shell pick up position and being responsive to forward movement of the bolt assembly from the recoil position to the battery position for moving said belt advancing pawl a shell distance outwardly in readiness for advancing the belt the next time the bolt assembly is moved rearwardly to the recoil position; and e. an ammunition clip holder and means for releasably attaching the clip holder to the receiver in place of the belt feeding adapter and belt advancing pawl.

2. The convertible gun as claimed in claim 1 wherein the belt feeding adapter includes at least one shell anti-back up pawl for preventing a shell in the shell pick up position from being moved outwardly away from said pick up position when the belt advancing pawl is moved outwardly in response to forward movement of the bolt assembly.

3. The convertible gun as claimed in claim 1 wherein said bolt assembly includes a shell extractor and an ejector recess in a region opposite to said extractor and wherein said cam follower includes a shell ejector portion which is caused, responsive to the bolt assembly moving rearwardly from the battery position to the recoil position, to move into said ejector recess and cause ejection, through said shell casing ejection port, of a shell casing held by the shell extractor when the bolt assembly has moved rearwardly to a preestablished position relative to said shell ejection port.

4. The convertible gun as claimed in claim 1 wherein the bolt assembly comprises a bolt and a bolt carrier and wherein the cam track is formed on the bolt carrier.

5. The convertible gun as claimed in claim 1 wherein the cam follower is pivotally mounted at a forward region to the receiver and wherein the cam track engaging portion is rearward of the pivotal mounting region.

6. The convertible gun as claimed in claim 1 wherein the belt advancing pawl is pivotally mounted to the cam follower and is spring-loaded so that when the cam follower is pivoted outwardly, in response to forward movement of the bolt assembly, the belt advancing pawl pivots to a retracted position as the belt advancing pawl is pushed outwardly under a shell in the belt to a position which enables the belt advancing pawl to advance the belt one shell position when the cam follower is subsequently pivoted inwardly in response to the bolt assembly moving rearwardly from the battery position.

7. The convertible gun as claimed in claim 1 wherein the belt feeding adapter comprises a lower, body portion and an upper, cover portion, the body and cover portions being hinged together so that the cover portion can be opened relative to the body portion without detaching the belt feeding adapter from the receiver, an ammunition belt being receivable into the adapter when the cover portion is open and being retained in the belt feeding adapter when the cover portion is then closed.

8. A convertible, belt/clip-fed automatic gun, which comprises:

a. a gun barrel having a breech;

b. a receiver connected to the barrel and having a battery positioned disposed adjacent said barrel breech, a shell pick up position and a shell casing ejection port;

c. a bolt assembly slidably mounted in the receiver for reciprocating movement, in response to firing of the gun, between the battery position and a recoil position rearwardly of the shell pick up position and the shell casing ejection port, the bolt assembly including a bolt having means for picking up a shell from the pick up position upon forward bolt assembly movement and for loading the picked up shell into the barrel breech and, after firing, for extracting a fired shell casing from the barrel breech upon rearward recoil movement from the battery position to the recoil position, and including a bolt carrier having an ammunition belt advancing and casing ejection cam track formed thereon;

d. ammunition belt receiving and advancing means, comprising a cam follower pivotally mounted to the receiver, at least one belt advancing pawl mounted to the cam follower, a belt feeding adapter for receiving an ammunition belt and means for releasably attaching said belt feeding adapter to the receiver at a position adjacent to said shell pick up position and in a cooperative relationship with said cam follower, said cam follower having a cam track following portion in engagement with said bolt assembly cam track and being thereby responsive to rearward movement of the bolt assembly from the breech to the recoil position for causing said belt advancing pawl to inwardly advance an ammunition belt held by the belt feeding adapter in a manner moving shell in the belt into the shell pick up position and being responsive to forward movement of the bolt assembly from the recoil position to the battery position for moving said belt advancing pawl a shell distance outwardly in readiness for advancing the belt the next time the bolt assembly is moved rearwardly to the recoil position and said belt feeding adapter including at least one shell anti-back up pawl for preventing a shell in the pick up position from being moved outwardly away from said pick up position when the belt advancing pawl in moved outwardly in response to forward movement of the bolt assembly; and e. an ammunition clip holder and means for releasably attaching the clip holder to the receiver in place of the belt feeding adapter and belt advancing pawl.

9. The convertible gun as claimed in claim 8 wherein said means for extracting a fired shell casing include a shell extractor pivotally mounted to the bolt and an ejector recess formed in a forward region of the bolt opposite said extractor and wherein said cam follower includes a shell ejector portion which is caused, responsive to the bolt assembly moving rearwardly from the breech to the recoil position, to move into said ejector recess in the bolt and cause ejection, through said shell casing ejection port, of a shell casing held by the shell extractor when the bolt assembly has moved rearwardly to a preestablished position relative to said shell ejection port.

10. The convertible gun as claimed in claim 8 wherein the cam follower is pivotally mounted at a forward region to the receiver and wherein the cam track following portion is rearward of said pivotal mounting region.

11. The convertible gun as claimedd in claim 8 wherein the belt advancing pawl is pivotally mounted to the cam follower and is spring-loaded so that when the cam follower is pivoted outwardly, in response to forward movement of the bolt carrier with said cam follower portion if engagement with the bolt carrier cam track, the belt advancing pawl pivots to a retracted position as the belt advancing pawl is pushed outwardly under a shell in the belt to a position which enables the belt advancing pawl to advance the belt one shell position when the cam follower is pivoted inwardly in response to the bolt assembly moving rearwardly from the battery position.

12. The convertible gun as claimed in claim 8 wherein the belt feeding adapter comprises a lower, body portion and an upper, cover portion, the body and cover portions being hinged together so that the cover portion can be opened relative to the body portion without detaching the belt feeding adapter from the receiver, an ammunition belt being insertable in the belt feeding adapter when the cover portion is open and being retained in the belt feeding adapter when the cover portion is then closed.

13. A belt fed automatic gun with positive shell casing ejection, which comprises:

a. a gun barrel having a breech;

b. a receiver connected to the barrel and having a battery position disposed adjacent said barrel breech, shell pick up position and a shell casing ejection port;

c. a bolt assembly slidably mounted in the receiver for reciprocating movement, in response to firing of the gun, between the barrel battery position and a recoil position rearwardly of the shell pick up position and the shell casing ejection port, the bolt assembly having means for picking up a shell from the pick up position upon forward bolt assembly movement and for loading the pick up shell into the barrel breech and, after firing, for extracting a fired shell casing from the barrel breech upon rearward recoil movement from the battery position to the recoil position, said bolt assembly having an ammunition belt advancing and shell casing ejection cam track formed thereon, said bolt assembly including a shell extractor and an ejector recess in a region opposite to said extractor;

d. ammunition belt receiving and advancing means, comprising a cam follower pivotally mounted to the receiver, at least one belt feeding adapter for receiving an ammunition belt and and means for releasably attaching said belt feeding adapter to the receiver at a position adjacent to said shell pick up position and in a cooperative relationship with said cam follower, said cam follower having a cam track following portion thereof in engagement with said bolt assembly cam track and being thereby responsive to rearward movement of the bolt assembly from the battery position to the recoil position for causing said belt advancing pawl to inwardly advance an ammunition belt held by the belt feeding adapter in a manner moving a shell in the belt into the shell pick up position and being responsive to forward movement of the belt assembly from the recoil position to the battery position for moving said belt advancing pawl a shell distance outwardly in readiness for advancing the belt the next time the bolt is moved rearwardly to the recoil position, said cam follower including a shell ejector portion which is caused, responsive to the bolt assembly moving rearwardly from the battery position to the recoil position, to move into said bolt assembly ejector recess and cause ejection, through said shell casing ejection port, of a shell casing held by the shell extractor when the bolt assembly has moved rearwardly to a preestablished position relative to said shell ejection port.

14. The automatic gun as claimed in claim 13 wherein the belt feeding adapter includes at least one shell anti-back up pawl for preventing a shell in the pick up position from being moved outwardly away from said pick up position when the belt advancing pawl is moved outwardly in response to forward movement of the bolt assembly.

15. The automatic gun as claimed in claim 13 including an ammunition clip holder and means for releasably attaching the clip holder to the receiver in place of the belt feeding adapter and belt advancing pawl.

16. The automatic gun as claimed in claim 13 wherein the bolt assembly comprises a bolt and a bolt carrier and wherein the cam track is formed on the bolt carrier.

17. The automatic gun as claimed in claim 13 wherein the cam follower is pivotally mounted at a forward region to the receiver and wherein the cam track engaging portion is rearward of the pivotal mounting region.

18. The automatic gun as claimed in claim 13 wherein the belt advancing pawl is pivotally mounted to the cam follower and is spring loaded so that when the cam follower is pivoted outwardly, in response to forward movement of the bolt assembly, the belt advancing pawl pivots to a retracted position as the belt advancing pawl is pushed outwardly under a shell in the belt to a position which enables the belt advancing pawl to advance the belt one shell position when the cam follower is subsequently pivoted inwardly in response to the bolt assembly moving rearwardly from the battery position.

19. The automatic gun as claimed in claim 13 wherein the belt feeding adapter comprises a lower, body portion and an upper, cover portion, the body and cover portions being hinged together so that the cover portion can be opened relative to the body portion without detaching the belt feeding adapter from the reciever, an ammunition belt being receivable into the belt feeding adapter when the cover portion is open and being retained in the belt feeding adapter when the cover portion is then closed.

20. The automatic gun as claimed in claims 1, 8 or 13 wherein the cam trach comprises a substantially linear recess formed at an angle of between substantially 5° and 10° relative to a bore axis of the gun.

21. The automatic gun as claimed in claim 20 wherein said angle is substantially 6°.

22. The automatic gun as claimed in claims 1, 8 or 15 wherein the clip holder and the means for attaching the clip holder to the receiver are configured for holding a clip at angle causing the clip to be out of the sight path of the gun.

* * * * *